US006631541B2

(12) United States Patent
Mosing et al.

(10) Patent No.: US 6,631,541 B2
(45) Date of Patent: Oct. 14, 2003

(54) HAMMER PISTON HANDLING APPARATUS

(75) Inventors: Donald E. Mosing, Lafayette, LA (US); David L. Sipos, Youngsville, LA (US)

(73) Assignee: Frank's Casing Crew and Rental Tools, Inc., Lafayette, IN (US)

( * ) Notice: Subject to any disclaimer, the term of this patent is extended or adjusted under 35 U.S.C. 154(b) by 33 days.

(21) Appl. No.: 09/924,300

(22) Filed: Aug. 8, 2001

(65) Prior Publication Data

US 2003/0046800 A1 Mar. 13, 2003

(51) Int. Cl.[7] ..... B23P 19/04
(52) U.S. Cl. ..... 29/252; 29/281.1
(58) Field of Search ..... 29/252, 251, 281.1; 254/108

(56) References Cited

U.S. PATENT DOCUMENTS

| | | | | | |
|---|---|---|---|---|---|
| 3,825,363 | A | * | 7/1974 | Lanman | 408/104 |
| 4,532,689 | A | * | 8/1985 | Harder et al. | 29/267 |
| 4,763,394 | A | * | 8/1988 | Decato et al. | 29/252 |
| 5,564,179 | A | * | 10/1996 | Aumuny | 29/726 |
| 5,680,688 | A | * | 10/1997 | Garner | 29/243.51 |
| 5,988,597 | A | * | 11/1999 | Egan | 254/279 |
| 5,988,959 | A | * | 11/1999 | Sugata | 409/141 |
| 6,247,216 | B1 | * | 6/2001 | Rader, Jr. | 29/252 |

* cited by examiner

*Primary Examiner*—Lee D. Wilson
(74) *Attorney, Agent, or Firm*—John D. Jeter

(57) ABSTRACT

A frame is supported on adjustable jacks for aligning with a pile driver hammer body for removal or installation of the hammer piston. A terminal tube on the frame clamps to the hammer and a powered ram moves the piston.

9 Claims, 3 Drawing Sheets

HAMMER PISTON HANDLING APPARATUS

SUMMARY OF INVENTION

The piston carrier has an elongated frame with leveling and positioning legs. The legs are extendable from the sides of the frame to achieve stable width, and the legs are individually extendable for leveling and height positioning of the frame.

At the end of the frame to be clamped to the hammer, when hammer and carrier are aligned, a terminal tube with a bore corresponding to the cylinder bore of the hammer receives the emerging piston. The terminal tube is part of the carrier. Means to attach the frame to the hammer is, preferably, a terminal tube attached to the frame. A carrier is comprised of at least a frame, means to attach said frame to a hammer, and frame supporting structure, preferably, adjustable legs.

Once aligned, the piston still must be moved by substantial force. The needed force, for movement to or from the carrier, is provided by a forcing means, preferably, a hydraulic ram. The preferred ram is a short stroke unit to save space, and moves in a selected and reversible direction, in repeated short excursions, to walk the piston to the intended final position. The ram is on a ram carriage that moves on the frame, in ratcheting cycles, along the axial direction of the terminal tube. The force ram arrangement is provided with a threaded coupler, to be installed on the piston, to couple the piston to the ram.

If the carrier is to be used only with bored out and sleeve fitted hammers, the terminal tube on the carrier can have a bore of the same diameter as the bored-out hammer cylinder bore. When the piston is later installed in the bored out body, the rings move down to the taper below the former catch ring receiving groove and are compressed into their respective grooves during the travel to the close-fitting cylinder bore.

If the carrier is to be used to install pistons into hammers not bored out above the catch ring receiving groove the terminal tube on the carrier has the same diameter as the close fitting portion of the cylinder bore of the hammer.

To pull a piston past the bored-out end of the hammer and into a close fitting bore on the carrier terminal tube, a sleeve with a tapered bore is inserted into the enlarged bore to re-compress the rings as the rings progress toward the close fitting bore of the carrier terminal tube. The piston then rests in the carrier with the rings compressed into their respective piston grooves.

These and other objects, advantages, and features of this invention will be apparent to those skilled in the art from a consideration of this specification, including the attached claims and appended drawings.

DETAILED DESCRIPTION OF DRAWINGS

Figure 1:
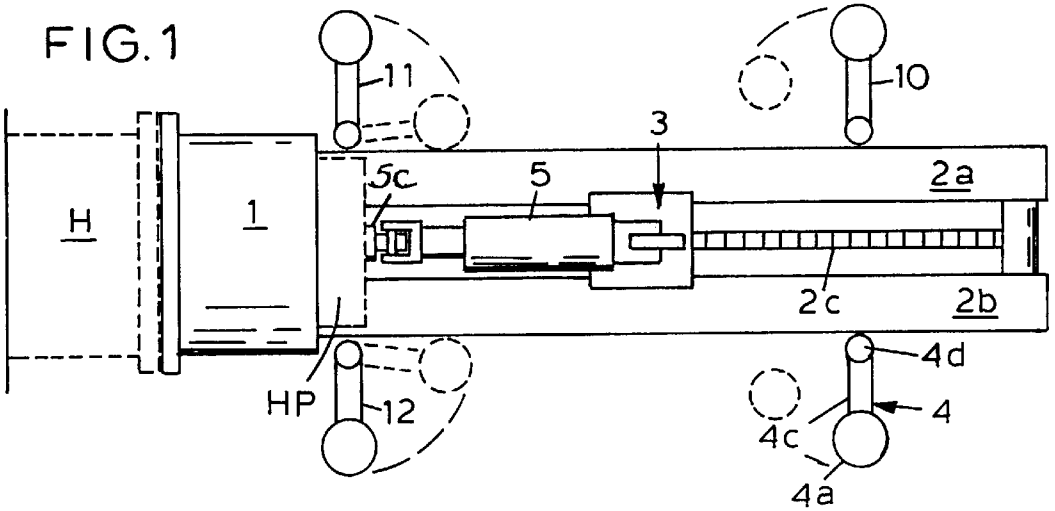

FIG. 1 shows hammer H aligned with the apparatus in the relationship to accept the transfer of the piston HP to the apparatus.

Support and positioning jacks 4, 10, 11, and 12 are distributed around the frame 2. Only jack 4 has parts captioned. Flanged terminal tube 1 is the means to anchor the hammer to the apparatus. Terminal tube 1 has a flange 1*a* to be clamped to the upper flange of the hammer serviced. Longitudinal beams 2*a* and 2*b* function as a frame, carry the force cylinder 5 on carriage 3, and transfer loads to the jacks.

The piston HP is accessed by an adapter 5*c* which is engaged by the pin of clevis 5*c* which is part of the force cylinder 5. Hammer pistons normally have a threaded hole in the center of the top for such adapters.

Force cylinder 5 moves in short strokes to move the piston HP a short distance and, on the reverse stroke, the carriage 3 slides on the flanges of beams 2*a* and 2*b*. A few strokes will transfer a piston. The ratcheting action of carriage 3 is reversible to achieve a reverse transfer.

Figure 2:
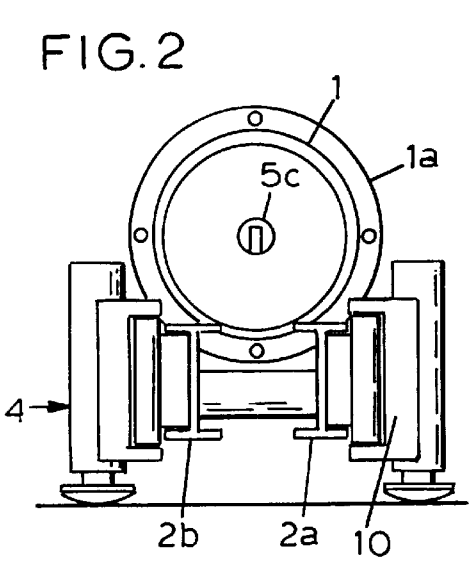

FIG. 2 shows the preferred support and positioning jack system. Carriage 3 and related parts are not shown. Hard point 4*d* has a vertical axis to carry web 4*c* and is welded to the longitudinal frame beam 2*b*. Cylinder body 4*a* is attached to web 4*c* which has hinge hubs that are carried by hard point 4*d*. The jacks fold alongside the frame for transport as shown by dashed lines. End view 2 shows the jacks 4 and 10, partly folded.

Figure 3:
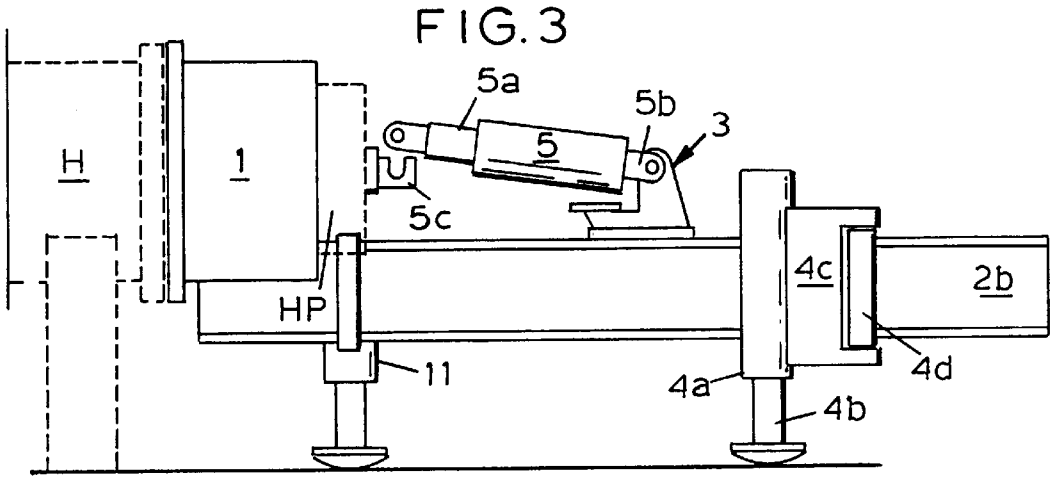

FIG. 3 shows cylinder 5 tilted to disconnect from the adapter 5*c* that screws into the top of the piston. The details of the ratcheting contrivance related to carriage 3 are deferred to FIGS. 4 and 5. The jack 12 is removed to show only the frame hard point 12*d*. All Jack details are identical to those on jack 4.

Figure 5:
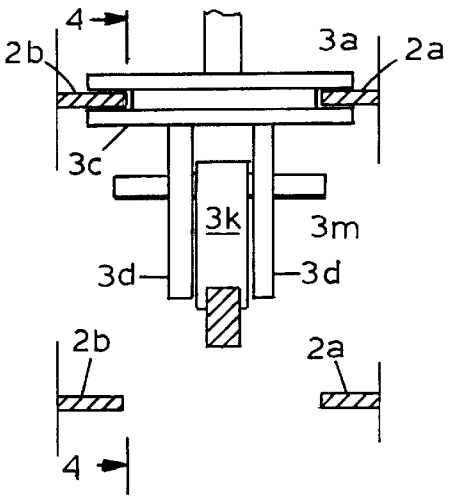
Figure 4:
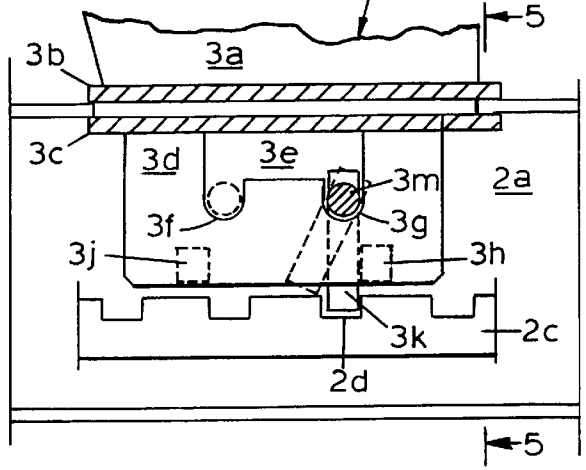

FIGS. 4 and 5 show details related to the shuttle carriage 3 of FIG. 1. Carriage 3 moves longitudinally between the base beams and rides the upper flanges of those beams. Longitudinal thrust rod 2*c* is secured to the frame by means not shown and has notches 2*d* separated by buttresses. Flapper 3*k* can swing leftward as shown by dotted lines and allows the carriage to move rightward, but the flapper cannot swing rightward because it hits barrier 3*h*. Carriage 3, then, can only move rightward. If the pivot cross bar 3*m* of the flapper is lifted out of slot 3*g* and moved to slot 3*f*, the carriage will move leftward only because barrier 3*j* requires reverse swing directions for the flapper. Cutout 3*e* provides clearance for manipulation of the flapper.

Figure 9:
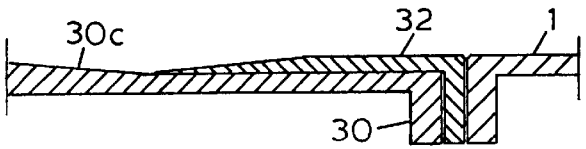
Figure 6:
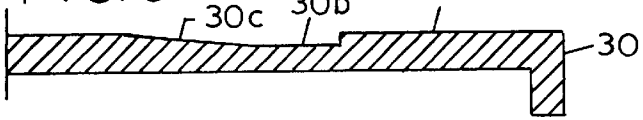
Figure 7:
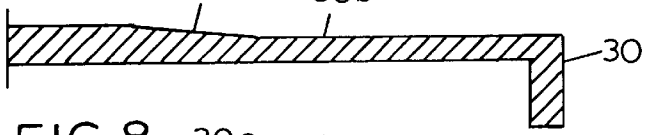
Figure 8:
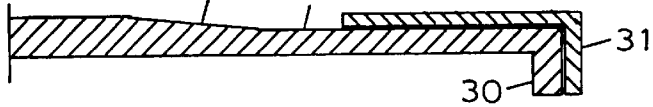

FIGS. 6 and 7 show sections through one wall of the upper end of the cylinder of the usual free-piston engine type pile driver. FIGS. 6 through 8 do not represent points of novelty of the present invention. FIG. 9 represents novel features that make it possible to use a carrier with a bore closely fitting the hammer piston to remove and replace pistons from any bore condition shown in FIGS. 6 and 7. There is no reason to transfer a piston to or from a bore fitted with the sleeve of FIG. 8.

FIG. 6 shows a common hammer cylinder with a catch ring receiving groove. The catch ring receiving groove has a bore taper 30*c* to a larger diameter groove 30*b* ended by abutment 30*d*. The groove 30*b* is of such diameter that a ring can come only part way out of its related piston groove to engage abutment 30*d*. That stops the upward travel of a piston. Assuming no hammer damage, the piston slides back down the bore with cone 30*c* compressing the ring back into the ring groove. A piston could be installed from the top (right) end of the cylinder. Each ring, in it's turn, would emerge some from the related groove as it passed abutment 30*d* but it would be pushed back into the groove by conic surface 30*c*. The piston, however, cannot be removed from the top.

The hammer cylinder is modified by boring out the cylinder above abutment 30*d* to allow the rings to move upward and out of the cylinder.

Safety interests require that the catch ring be effective in the field. The sleeve 31 is installed such that its lower end duplicates the former abutment 30*d*. The upper flange of the sleeve is captured between flanges in the fully assembled hammer as shown in FIG. 9.

In FIG. 9, sleeve 32 is provided for a bored out cylinder, after sleeve 31 is removed. Sleeve 32, ideally, reaches very close to the big end of the surface 30*c* so that it picks up the outer periphery of an upwardly moving ring before the ring expands to bear against the enlarged wall of the bored-out cylinder. That reduces the need for a sharp end on sleeve 32 in case outer bevels are not on the rings to be compressed.

To pull a piston past the bored-out end of the hammer and into a close fitting bore on the carrier terminal tube, a sleeve with a tapered bore is inserted into the enlarged bore to re-compress the rings as the rings progress toward the close fitting bore of the carrier terminal tube. The piston then rests in the carrier with the rings compressed into their respective piston grooves.

In case a sleeve 32 is not available, the piston can still be pulled from the hammer until the rings engage the face of terminal tube 1 on the carrier. The carrier can the be moved back from the hammer, exposing the rings. A ring compressor band can then be used to compress the rings. The carriers cylinder 5 can then move the piston back into the close fitting bore of the terminal tube.

By tapering both ends of the bore of the terminal tube, rings can be compressed when entering the tube from either end. Repaired pistons, returned to the carrier, enter the tube from the right end as shown in the drawings.

Figure 10:
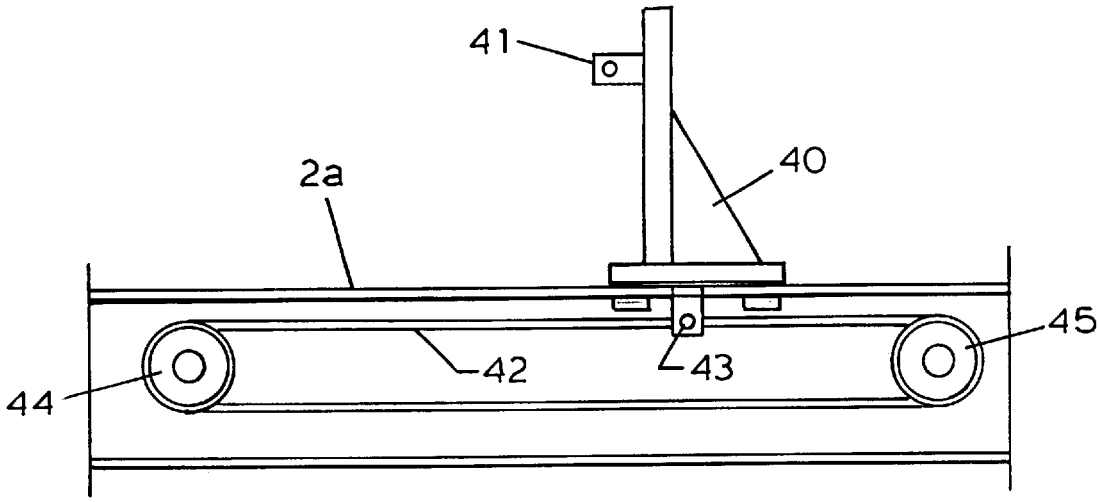

FIG. 10 shows an alternate machine to manipulate hammer pistons. On frame 2*a*, carriage 40 slides longitudinally, attached at coupler means 43 to chain 42. Chain 42 is driven by powered sprocket 45, and distributed by idler sprocket 44. Adapter 41 connects the carriage to the piston to be moved.

Figure 11:
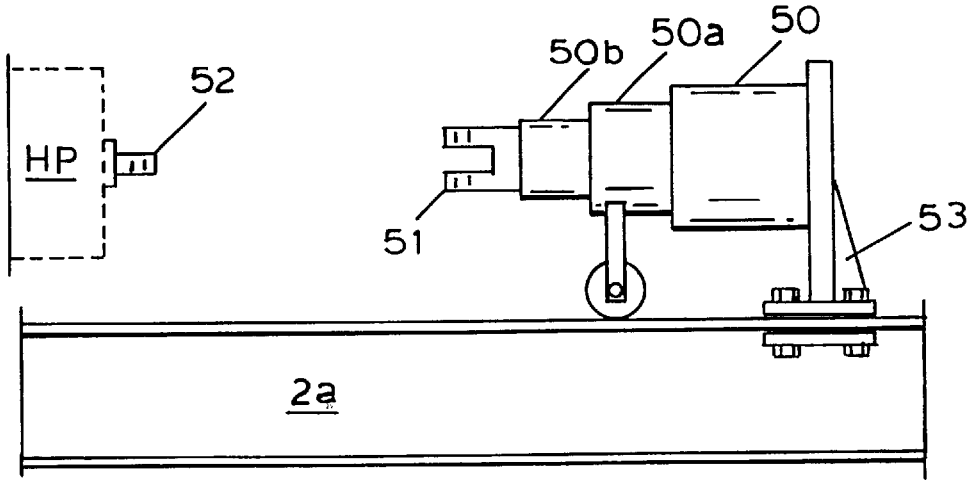

FIG. 11 shows an alternate force means for moving piston HP. Multi-stage hydraulic cylinder 50 is mounted on stationary bracket 53. The cylinder 50 has two overlapping telescoping members, 50*a* and 50*b*. Cylinder 50 has enough stroke to move the piston as needed in single excursions. Adapter 51 is arranged for quick coupling to piston adapter 52.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

What is claimed is:

1. A piston manipulation apparatus for use with pile driving hammers, the apparatus comprising:

a) an elongated frame to receive a removed piston, and to support and direct piston forcing means, with adjustable standard means to support the frame above a preselected surface;

b) said piston forcing means arranged to ride the longitudinal direction of said frame and exert piston moving force in said longitudinal direction, said piston forcing means having means to temporarily connect to said piston, and means to releasably connect to said frame; and c) attachment means to secure said elongated frame to said pile driving hammer.

2. The apparatus of claim 1 wherein said forcing means is a reciprocating force means, attached to said frame by directionally selectable ratcheting means such that reciprocal stroking of said force means causes said ratcheting means to proceed in one direction until reversed.

3. The apparatus of claim 1 wherein said forcing means is attached to the frame by a directionally selectable ratchet arrangement whereby said force means, in succeeding short strokes, progresses in one direction along said frame until switched to proceed in the opposite direction.

4. The apparatus of claim 1 wherein said forcing means is a hydraulic cylinder and said means to releasably connect to said frame is a ratchet means by which said cylinder can extend to move said piston in one direction and can retract to move said means to releasably connect to said frame in said one direction whereby several strokes of said cylinder can move said piston a distance equal to several said strokes of said cylinder.

5. The apparatus of claim 1 wherein said adjustable standard means is a plurality of jacks distributed about said frame.

6. The apparatus of claim 5 wherein said plurality of jacks are each carried by folding structure attached to said base by which the overall apparatus can be narrowed for transport and widened for stability, said jacks remaining functional for apparatus support in various positions related to said folding.

7. A piston handling apparatus for removing and replacing the piston of a pile driving hammer, the apparatus comprising:

a) a frame arranged to receive and support said piston;

b) support and positioning apparatus arranged to support said frame, above an underlying surface, and to align a first end of said frame with the piston bore of said hammer;

c) means to secure said frame to said hammer;

d) forcing means situated to move along said frame and push said piston into said hammer and to pull it from said hammer.

8. The apparatus according to claim 7 wherein said frame includes a terminal tube to receive said piston.

9. The apparatus according to claim 8 wherein the bore of said terminal tube is provided with a conical length on at least one end to receive said piston with expanded rings and compress said rings into the related piston ring grooves when said piston moves along said bore.

* * * * *